US005893462A

United States Patent [19]

Ridgeway

[11] Patent Number: 5,893,462

[45] Date of Patent: Apr. 13, 1999

[54] RETENTION PACKAGE

[75] Inventor: Devin C. Ridgeway, Chula Vista, Calif.

[73] Assignee: Sealed Air Corporation, Saddle Brook, N.J.

[21] Appl. No.: 09/108,691

[22] Filed: Jul. 1, 1998

[51] Int. Cl.[6] ..... B65D 71/00

[52] U.S. Cl. ..... 206/583

[58] Field of Search ..... 206/521, 583, 206/586, 591

[56] References Cited

U.S. PATENT DOCUMENTS

| | | | |
|---|---|---|---|
| 2,031,381 | 2/1936 | McCallum . | |
| 2,707,553 | 5/1955 | Yount . | |
| 2,802,565 | 8/1957 | Kabbash . | |
| 2,919,797 | 1/1960 | McCracken . | |
| 3,089,590 | 5/1963 | Mell . | |
| 3,424,306 | 1/1969 | Munck . | |
| 3,437,198 | 4/1969 | Van Saun et al. . | |
| 3,507,383 | 4/1970 | Rorer . | |
| 3,540,579 | 11/1970 | Hellstrom . | |
| 3,669,337 | 6/1972 | Struble . | |
| 3,718,275 | 2/1973 | Willinger . | |
| 3,891,090 | 6/1975 | Spiegel et al. . | |
| 3,905,474 | 9/1975 | Haibara . | |
| 3,966,046 | 6/1976 | Deutschlander . | |
| 4,030,603 | 6/1977 | Angell . | |
| 4,285,432 | 8/1981 | de Villers et al. . | |
| 4,306,653 | 12/1981 | Fales . | |
| 4,307,804 | 12/1981 | Benham . | |
| 4,324,357 | 4/1982 | Murkowski . | |
| 4,494,689 | 1/1985 | Ilitch . | |
| 4,606,460 | 8/1986 | Luray . | |
| 4,757,900 | 7/1988 | Misset et al. . | |
| 4,852,743 | 8/1989 | Ridgeway . | |
| 5,056,665 | 10/1991 | Boecker et al. . | |
| 5,086,925 | 2/1992 | Coalier et al. . | |
| 5,226,542 | 7/1993 | Boecker et al. . | |
| 5,251,760 | 10/1993 | Smith et al. . | |
| 5,259,507 | 11/1993 | Smith . | |
| 5,295,580 | 3/1994 | Hicks . | |
| 5,323,896 | 6/1994 | Jones . | |
| 5,388,701 | 2/1995 | Ridgeway . | |
| 5,522,539 | 6/1996 | Bazany | 206/586 X |
| 5,678,695 | 10/1997 | Ridgeway et al. . | |
| 5,823,348 | 10/1998 | Phillips et al. | 206/583 |

FOREIGN PATENT DOCUMENTS

| | | |
|---|---|---|
| 691904 | 8/1964 | Canada . |
| 49-59982 | 5/1974 | Japan . |
| 49-77087 | 7/1974 | Japan . |
| 50-88376 | 7/1975 | Japan . |
| 50-102778 | 8/1975 | Japan . |
| 50-107583 | 9/1975 | Japan . |
| 57-177969 | 11/1982 | Japan . |
| 3-100158 | 10/1991 | Japan . |

*Primary Examiner*—Jacob K. Ackun

*Attorney, Agent, or Firm*—Lerner, David, Littenberg, Krumholz & Mentlik, LLP

[57] ABSTRACT

A packaging structure is disclosed for holding an article securely between a flexible film and a pair of foldable flaps. The structure includes a frame having a main portion, and a pair of folding side legs and a pair of folding end legs supporting the main portion. The main portion defines a window, and a flexible web is connected to the folding side legs so that it extends across and below the window. A pair of flaps are foldably connected to the side legs. An article to be packaged is placed on the web and the flaps folded thereover to hold the article securely in place. The entire packaging structure may be placed in an outer box which holds the flaps in a closed position against the packaged article.

26 Claims, 9 Drawing Sheets

RETENTION PACKAGE

FIELD OF THE INVENTION

The present invention relates to packaging structures, and more particularly to packaging structures in which an article is held securely between a flexible film and a pair of foldable flaps.

BACKGROUND OF THE INVENTION

Protective packaging structures are often used when an article to be transported requires protection from physical shock, dust, dirt and other contaminants. For example, when shipping articles which may be relatively fragile, it is often desirable to package the article inside a box to protect the article from physical impacts to the box which may occur during loading, transit and unloading. In addition, when shipping sensitive electronic articles, such as computer components, it is often desirable to protect those components from dust and dirt. Aside from the shipping box itself, some additional structures are ordinarily needed to prevent the article from being damaged by uncontrolled movement within the box. Such additional structures have included paper or plastic dunnage, molded plastic foams, and foam-filled cushions, among others.

One useful form of packaging for especially fragile articles is referred to as suspension packaging, examples of which are disclosed in U.S. Pat. No. 4,852,743 to Louis H. Ridgeway and U.S. Pat. No. 5,388,701 to Devin C. Ridgeway. In suspension packaging, the article is suspended between two confronting sheets of plastic film. The sheets are usually attached to frames which are sized to fit securely within a selected size box. The fact that the article is not in contact with any substantially rigid surfaces protects it from physical shock. It is not necessary in all cases, however, for the article to be entirely suspended within the box, such as when packaging less fragile articles. In such cases, the extra space required for full suspension packaging becomes a less efficient use of such materials.

An alternative to suspension packaging is referred to as retention packaging, examples of which are disclosed in U.S. Pat. No. 5,678,695 to Devin C. Ridgeway et al. In retention packaging, an article is positioned between a sheet of flexible film and a rigid backing. The film is connected to folding side portions of the rigid backing such that the film is tightened against the article as the rigid side portions are folded away from the film. The folded structure fits within a selected box size which holds the article securely in place, but in contact on one side with a rigid surface. While retention packaging reduces the overall size of the packaging, placing the article between the flexible film and rigid backing is a cumbersome process and may increase the overall time needed to package each article. When packaging many thousands of articles, this incremental increase in time may have a substantial overall impact on shipping costs.

In a variant of the retention package described above, the package includes a rigid border extending around the entire periphery of a window opening, and side legs and end legs foldably connected to and supporting the border. A flexible film is connected to the underside of the border so that it extends across the window opening. An article to be packaged is placed on the film, and a series of four flaps connected to the four sides of the border are folded over the article to hold the article in place against the film. This packaging structure suffers from several drawbacks, including the need to hold the four flaps open in order to place the article on the film, the increased package size resulting from the requirement for a border extending around the entire periphery of the window opening, the need for a flap connected to each portion of the border to provide structural integrity to the border, and the need to increase the size of the window opening in order to accommodate articles which are thicker in cross-section.

There therefore exists a need for packaging structures which are easier and less time consuming to use than prior art packaging structures. Preferably, such structures will make efficient use of materials so as to be able to package articles in smaller containers than previously possible without sacrificing the strength of the packaging structure so as to risk damage to the articles packaged therein.

SUMMARY OF THE INVENTION

The present invention addresses these needs.

One aspect of the present invention provides a packaging structure for holding an article. The packaging structure includes a frame having a main portion defining a window opening, and a pair of side legs depending from the main portion. At least one flap may be foldably connected at one edge to one of the side legs for movement between an open position remote from the window opening and a closed position adjacent the window opening. The flap may include a cutout defining an opening therethrough when the flap is in the closed position. A flexible web may be connected to the side legs so as to extend across the window opening between the side legs, whereby an article may be held in place between the web and the flap.

In one embodiment in accordance with this aspect of the present invention useful for packaging articles having a thin profile, the web may be connected to the side legs adjacent the main portion. In another embodiment hereof useful for packaging articles having a taller profile, the web may be connected to the side legs at a spaced distance from the main portion.

In preferred embodiments, the packaging structure may further include a pair of end legs depending from the main portion. Each end leg may include an extension foldably connected to each of its ends so as to be foldable to a position in overlapping relationship with one of the side legs. The extensions may be sized so that they support the flexible web at its connection to the side legs. In accordance with this embodiment, each one of the pair of side legs may be connected to the pair of end legs at a position remote from the main portion. Such connections may be made by means of the foldable extensions, or through bellows connectors interconnecting one of the side legs with an adjacent one of the end legs.

In highly preferred embodiments, the packaging structure may further include a series of corner supports in the main portion for connecting the pair of side legs and the pair of end legs to the main portion. Each corner support may include a first edge foldably connected to one of the side legs, a second edge transverse to the first edge and foldably connected to one of the end legs, and a third edge interconnecting the first and second edges and defining a portion of the window opening.

In another embodiment in accordance with this aspect of the present invention, the packaging structure may include a second flap connected at one edge to another one of the side legs for movement between an open position remote from the window opening and a closed position adjacent the window opening. The free edge of the first flap in the closed position may confront the free edge of the second flap in the closed position to define a seam therebetween. In one arrangement, the seam may be positioned substantially along a centerline of the main portion. Alternatively, the seam may be positioned closer to one of the side legs than to the other one of the side legs. In a variant hereof, the free edge of the first flap may have a contour including a center portion and a pair of side portions on either side of the center portion, the center portion extending closer to the other one of the side legs than the side portions. The free edge of the second flap may define a contour which is complementary to the contour of the first flap.

Another aspect of the present invention provides a packaging assembly for holding an article. The packaging assembly may consist of a box and a packaging structure assembled in the box. The packaging structure may include any of the structural features described above.

Yet a further aspect of the present invention provides a method for packaging an article. In accordance with the method, a planar blank may be provided having a main portion defining a window opening, a pair of side legs foldably connected to the main portion, at least one flap foldably connected at one edge to one of the side legs, and a flexible web connected to the side legs so as to extend across the window opening between the side legs. The side legs may be folded downwardly, whereupon the at least one flap is pivoted to an open position coplanar with the side leg to which it is connected, and the flexible web is exposed through the window opening. The article may then be placed on the exposed flexible web and, while holding the side legs in a substantially fixed position, the at least one flap may be folded to a closed position over the article, whereupon the flexible web may be deformed by the article and the article may be held in place between the flexible web and the at least one flap.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

In the following are described multiple embodiments of the packaging structure of the present invention. In each embodiment, the packaging structure includes a structural frame and a flexible support web connected in selected regions thereto. The frame may be formed from any substantially rigid, lightweight, foldable material, such as cardboard, plastic, compressed foam, paperboard, corrugated cardboard and the like. A particularly preferred material is a single wall corrugated cardboard such as B-flute or E-flute corrugated cardboard. In accordance with techniques which are generally known in the packaging art, a single panel or blank of such material may be folded according to predetermined patterns to yield frames having a desired size and structural features for a particular application.

The support web may be formed from any flexible material which can cradle and support a packaged article without damaging it, and may include netting, spandex, lycra, rubber or other resilient materials. Preferably, the film is formed from a transparent and elastomeric polymer, and in preferred embodiments may be formed from polyvinyl chloride or polyurethane ester. By way of comparison, polyvinyl chloride films are generally less expensive and more transparent and may be more preferable for lightweight applications wherein a thickness of only 2–4 mils is necessary. Films made of polyurethane ester are generally more elastomeric and puncture resistant, and are therefore better suited for larger articles and articles having sharp protrusions. Polyurethane ester also is generally less sensitive to temperature changes and more tacky which is useful for restraining the packaged article from slipping. Polyurethane ester films may be manufactured with a slip agent, however, to control excessive tackiness. A particularly preferred resin used in the manufacture of the film is SP876, a commercially available product of the BASF Company. It will be appreciated, however, that a number of polymeric materials are suitable for forming the flexible film, and that such materials may be readily selected or custom designed by those of ordinary skill in the art to obtain the desired properties.

Figure 1:
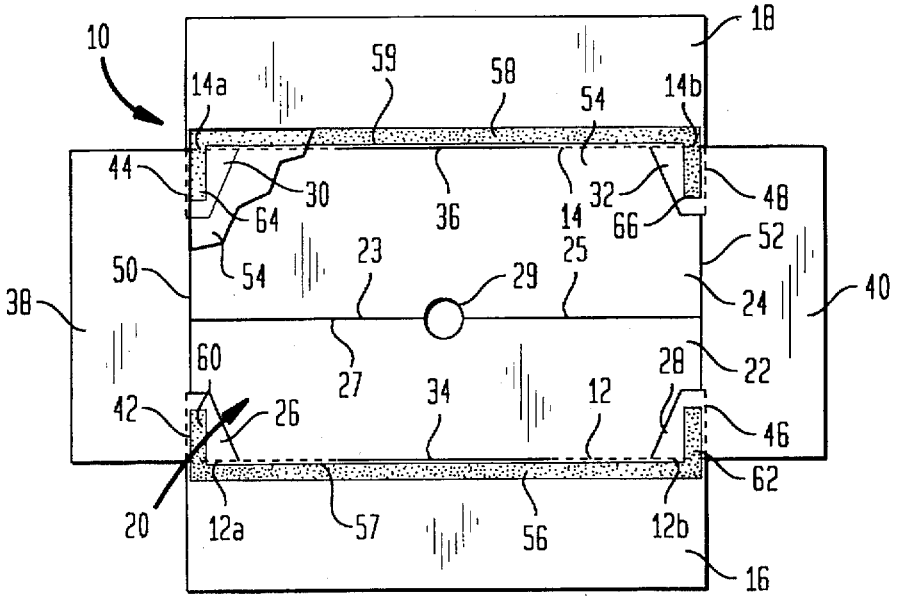
FIG. 1 is a plan view of a blank for forming a packaging structure in accordance with one embodiment of the present invention.

Referring to the figures, a blank 10 for forming a packaging structure 11 in accordance with one embodiment of the present invention is shown in FIG. 1. Packaging structure 11 is intended for use in packaging articles having a relatively thin profile. The broken lines depicted in FIG. 1, as well as in the other figures depicting blanks herein, represent lines along which the blank is creased, crimped, embossed, perforated, scored or otherwise weakened so as to be folded into the final shape of the packaging structure. The thickened full lines represent slits cut through the entire thickness of blank 10.

Blank 10 includes a pair of fold lines 12 and 14 which are generally parallel to and spaced from the opposite side edges of the blank, and which thus define folding side legs 16 and 18, respectively, and a main portion indicated generally at 20 therebetween. Main portion 20 may include a pair of flaps 22 and 24, and a series of corner portions 26, 28, 30 and 32. Flap 22 may be connected to side leg 16 along the portion of fold line 12 extending between corner portions 26 and 28, and has a width extending from fold line 12 to a free edge 23. In the same manner, flap 24 may be connected to side leg 18 along the portion of fold line 14 extending between corner portions 30 and 32, and has a width extending from fold line 14 to a free edge 25. By pivoting flaps 22 and 24 about these respective fold lines, the flaps may be moved between an open position in which they are spaced above corner portions 26, 28, 30 and 32 to reveal a window 33 in main portion 20, and a closed position in which they are coplanar with one another to form a layer covering substantially the entirety of window 33. The widths of flaps 22 and 24 may be substantially equal such that in the closed position their free edges 23 and 25 define a seam 27 which is disposed substantially along the centerline of main portion 20. Cutouts in free edges 23 and 25 may also define a finger hole 29 in the closed position providing a location to grasp the flaps for movement from the closed position to the open position. Alternatively, one or more finger holes may be provided entirely within the body of one or both of flaps 22 and 24.

Fold line 12 may include one or more through slits 34 extending partially along its length, leaving a sufficient portion of the fold line intact to securely join flap 22 to side leg 16. Similarly, one or more through slits 36 may extend partially along the length of fold line 14, leaving a sufficient portion of the fold line intact to securely join flap 24 to side leg 18. Slits 34 and 36 facilitate the folding of flaps 22 and 24 between the open and closed positions by reducing the amount of material which has to be folded.

Blank 10 may further include a pair of folding end legs 38 and 40 which extend along the width of main portion 20. End leg 38 may be connected to corner portions 26 and 30 along colinear fold lines 42 and 44, respectively. In the same manner, end leg 40 may be connected to corner portions 28 and 32 along colinear fold lines 46 and 48, respectively. The slit 50 defining the top of end leg 38 (in the folded condition of packaging structure 11) and one end of flaps 22 and 24 may be offset inwardly from fold lines 42 and 44. Similarly, the slit 52 defining the top of end leg 40 (also in the folded condition of packaging structure 11) and the other end of flaps 22 and 24 may be offset inwardly from fold lines 46 and 48. The purpose of these offsets will be described more fully below in connection with the embodiment of FIG. 7.

A flexible film 54 is superimposed on one surface of blank 10 so that it extends across main portion 20. One edge of film 54 may be connected to side leg 16, and the opposite edge of film 54 may be connected to side leg 18. The connection of film 54 to blank 10 may be made by any suitable means, including stapling, gluing, heat or ultrasonic welding, sewing and the like. In a particularly preferred arrangement, film 54 may be adhered to side legs 16 and 18 by a pair of glue strips 56 and 58, glue strip 56 being positioned on side leg 16 adjacent fold line 12 and glue strip 58 being positioned on side leg 18 adjacent fold line 14. Optionally, film 54 may further be connected to the underside of corner portions 26, 28, 30 and 32, such as through the use of glue strip extensions 60, 62, 64 and 66. The purpose of the glue strip extensions will be discussed below in connection with the use of packaging structure 11.

Figure 2:
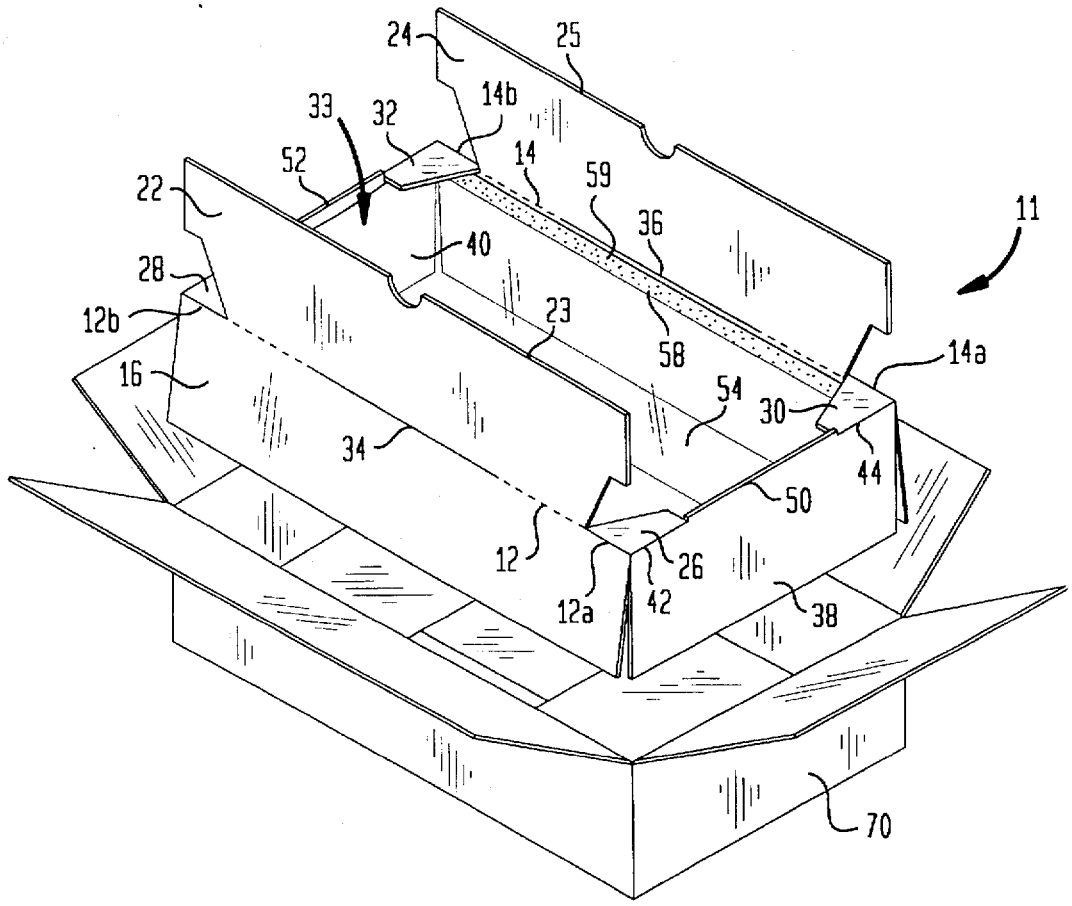
FIG. 2 is a perspective view of the packaging structure constructed from the blank of FIG. 1, the packaging structure being in an open condition and ready for insertion into an outer container.
Figure 3:
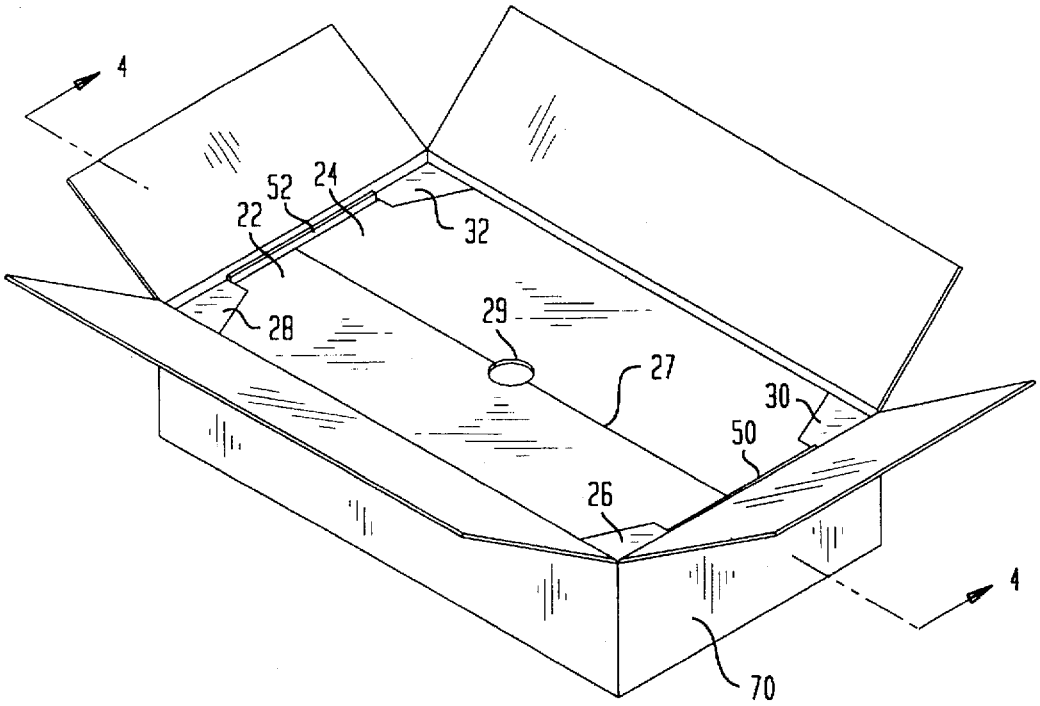
FIG. 3 is a perspective view of the packaging structure of FIG. 2 in a closed condition within an outer container.
Figure 4:
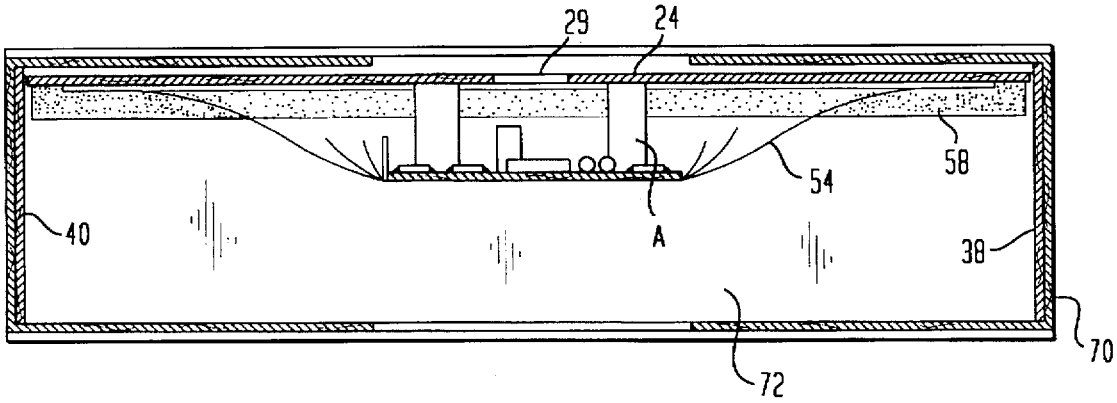
FIG. 4 is a front cross-sectional view taken along line 4—4 of FIG. 3.

The formation of packaging structure 11 from blank 10 and the use of the packaging structure to securely hold an article A can best be understood with reference to FIGS. 2–4. With blank 10 in a face up orientation (i.e., with glue strips 56 and 58 facing downwardly), packaging structure 11 may be formed simply by folding side leg 16 downwardly along fold line 12, side leg 18 downwardly along fold line 14, end leg 38 downwardly along fold lines 42 and 44, and end leg 40 downwardly along fold lines 46 and 48. The folding of legs 16, 18, 38 and 40 may be facilitated through the use of a support pedestal (not shown) having a length and width which correspond to the length and width of main portion 20, and a height which is at least as great as the distance between main portion 20 and the lowermost free edges of the legs. In such arrangement, blank 10 may be positioned with main portion 20 aligned over the pedestal, and legs 16, 18, 38 and 40 may be folded downward simultaneously in one motion. Since flap 22 is connected only to side leg 16 and is completely severed from the remainder of blank 10, the action of folding side leg 16 downwardly causes flap 22 to rotate upwardly so as to remain in coplanar relationship with the side leg, as shown in FIG. 2. That is, as side leg 16 is folded downwardly, the only folds which actually take place are along the portion **12*a* of fold line 12 between side leg 16 and corner portion 26 and the portion 12*b* of fold line 12 between side leg 16 and corner portion 28. The remainder of fold line 12 remains in an unfolded condition. Likewise, flap 24 is connected only to side leg 18 and is completely severed from the remainder of blank 10. Accordingly, as side leg 18 is folded downwardly, the only folds which actually take place are along the portion 14*a* of fold line 14 between side leg 18 and corner portion 30 and the portion 14*b* of fold line 14 between side leg 18 and corner portion 32. Thus, folding side leg 18 downwardly causes flap 24 to rotate upwardly so as to remain in coplanar relationship with the side leg. The movement of flaps 22 and 24 to an upward position causes film 54 to be revealed across window 33**.

As noted above, the glue strips 56 and 58 adhering film 54 to side legs 16 and 18 may be positioned adjacent fold lines 12 and 14. Accordingly, as side legs 16 and 18 are folded downwardly, the inner edges 57 and 59 of the glue strips pivot about the fold lines, but otherwise do not substantially move in a vertical or horizontal direction relative to the fold lines. As a result, in the folded condition of packaging structure 11, film 54 extends tightly across window 33 in a position subjacent corner portions 26, 28, 30 and 32, leaving essentially no gap between film 54 and flaps 22 and 24 when the flaps are in the closed position.

With the side and end legs folded downwardly, packaging structure 11 may be inserted into an empty box 70 having inner dimensions which correspond in height, width and length to the folded packaging structure. The article A to be packaged may then be placed on the surface of film 54, preferably in a central region thereof, and flaps 22 and 24 may be folded downwardly over the top of the article. Since side legs 16 and 18 are held in place by the sidewalls of box 70, the folding movement of flaps 22 and 24 toward the closed position causes folds to be made along the portion of fold line 12 between corner portions 26 and 28, and along the portion of fold line 14 between corner portions 30 and 32. As flaps 22 and 24 are closed, they contact article A before they reach the fully closed position. As further pressure is exerted against the flaps to bring them into substantially coplanar relationship with one another, the applied force presses article A into film 54, causing film 54 to deflect downwardly into the open space 72 between the film and the bottom of box 70, all of which can be seen in the cross-sectional view of FIG. 4. With flaps 22 and 24 in or close to the closed position, the outer flaps of box 70 may be folded over the top of packaging structure 11 and may be sealed in a conventional manner using tape, glue, staples or other well-known techniques to hold the box and the packaging structure therein closed.

With packaging structure 11 assembled in place in box 70, legs 16, 18, 38 and 40 cooperate with corner portions 26, 28, 30 and 32 to define a frame structure for supporting film 54 and article A positioned thereon at a spaced distance above the bottom of the box. The compression of article A into film 54 and the resultant deformation of film 54 holds the article securely in place. In this regard, an extra amount of support is provided by glue strip extensions 60, 62, 64 and 66. Not only do the glue strip extensions spread the support of film 54 over a greater portion of the frame structure, they also reduce the unsupported length of film 54 between glue strips 56 and 58 so as to hold article A more tightly against flaps 22 and 24. This is particularly effective for very thin articles which would stretch film 54 by only a small amount.

Figure 5:
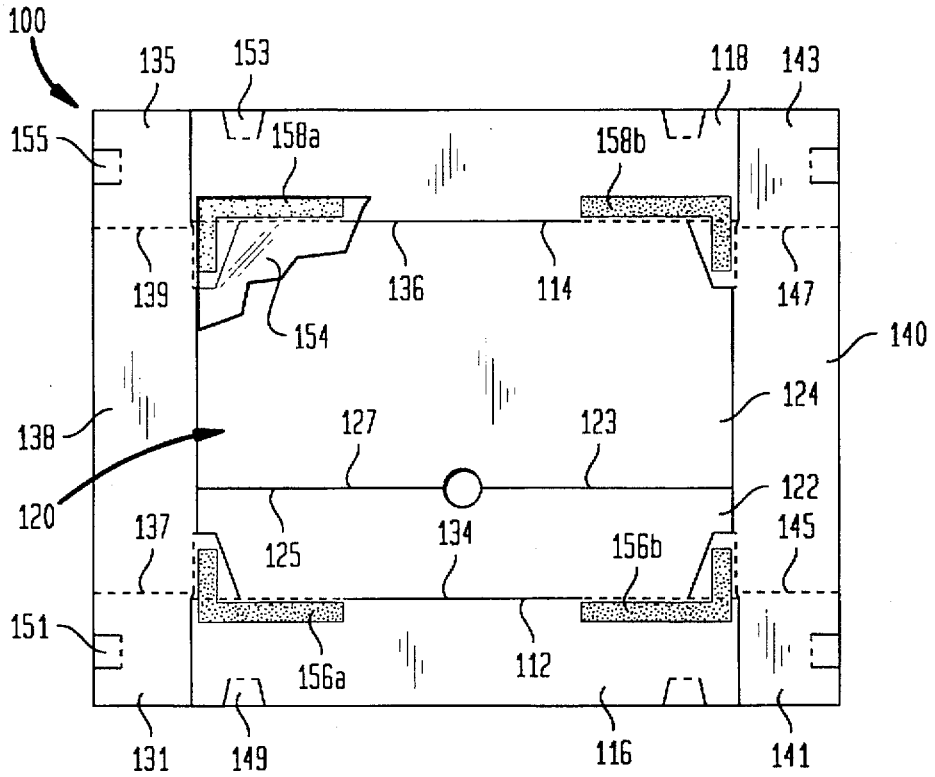
FIG. 5 is a plan view of a blank for forming a packaging structure in accordance with a second embodiment of the present invention.

A blank 100 for forming a packaging structure 111 in accordance with a second embodiment of the present invention is shown in FIG. 5. Blank 100 is similar in construction to blank 10 described above. However, unlike the flaps 22 and 24 of blank 10 described above, the flaps 122 and 124 of blank 100 are not substantially equal in width. That is, flap 124 is wider than flap 122 such that the distance between fold line 112 and free edge 123 of flap 122 is less than the distance between fold line 114 and free edge 125 of flap 124. As a result, in the closed position, free edges 123 and 125 define a seam 127 which is offset from the centerline of main portion 120.

Also unlike blank 10, the folding end legs 138 and 140 of blank 100 may include extensions on the opposite ends thereof such that blank 100 circumscribes a substantially complete rectangle. Thus, end leg 138 may include extensions 131 and 135 which are foldably connected to the opposite ends of end leg 138 by fold lines 137 and 139, respectively. Similarly, end leg 140 may include extensions 141 and 143 which are foldably connected to the opposite ends of end leg 140 along fold lines 145 and 147. The purpose of these extensions will be described more fully below in connection with the assembly and use of packaging structure 111.

In addition, rather than using continuous glue strips 56 and 58, a pair of shorter glue strips **156*a* and 156*b* may be used to adhere film 154 to side leg 116, and a pair of glue strips 158*a* and 158*b* may be used to adhere film 154 to side leg 118. Glue strips 156*a* and 156*b* may be positioned adjacent the solid portions of fold line 112, i.e., on either side of the slit 134 through the fold line. Likewise, glue strips 158*a* and 158*b* may be positioned adjacent fold line 114 on either side of through slit 136**.

Figure 6:
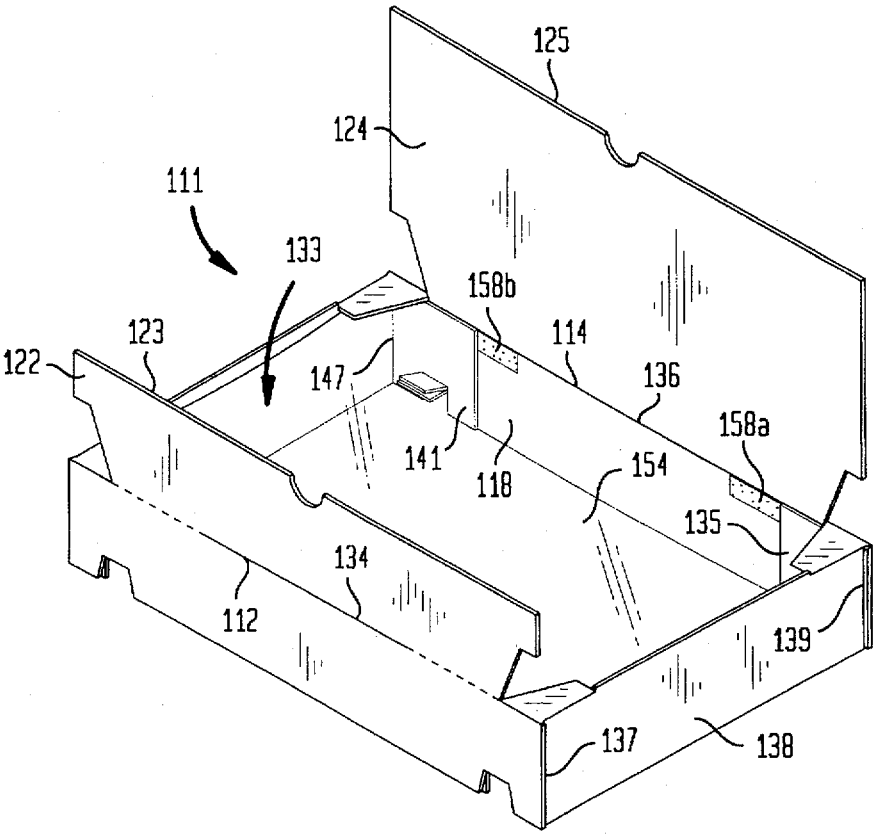
FIG. 6 is a perspective view of the packaging structure constructed from the blank of FIG. 5.

Using substantially the same technique as described above in connection with blank 10, blank 100 may be folded to form the packaging structure 111 shown in FIG. 6. When folding end leg 138 downwardly, however, extension 131 may be folded inwardly toward main portion 120 along fold line 137, and extension 135 may be folded inwardly toward main portion 120 along fold line 139 so that the extensions lie inwardly of side legs 116 and 118. In this position, the dovetail cut tab 149 in side leg 116 will be aligned with the rectangular cut tab 151 in extension 131, and the dovetail cut tab 153 in side leg 118 will be aligned with the rectangular cut tab 155 in extension 135. End leg 138 may then be joined to side leg 116 by deflecting tabs 149 and 151 inwardly until tab 149 interlocks with the cutout remaining in extension 131 following the deflection of tab 151. End leg 138 may be joined to side leg 118 in like fashion by deflecting tabs 153 and 155 inwardly until tab 153 interlocks with the cutout remaining in extension 135 following deflection of tab 155. In the same manner, when folding end leg 140 downwardly, extension 141 may be folded inwardly along fold line 145 and extension 143 may be folded inwardly along fold line 147 so that these extensions also lie inwardly of side legs 116 and 118. End leg 140 may be joined to both side leg 116 and side leg 118 by interlocking the tabs in the side legs with the tabs in extensions 141 and 143. It will thus be appreciated from the foregoing that packaging structure 111 may be preassembled and held in the folded condition without the need for an outer box.

As with blank 10 described above, folding side legs 116 and 118 downwardly causes flaps 122 and 124 to rotate to the open position shown in FIG. 6, revealing film 154 pulled tightly across and immediately subjacent to window 133. The article to be packaged may then be placed on the surface of film 154, and flaps 122 and 124 may be folded downwardly thereover. Since side legs 116 and 118 are held in place by their interconnection with end legs 138 and 140, the folding movement of flaps 122 and 124 toward the closed position causes folds to be made along the portion of fold line 112 joining side leg 116 to flap 122, and along the portion of fold line 114 joining side leg 118 to flap 124. With flaps 122 and 124 in the closed position over the packaged article, packaging structure 111 may be enclosed within an outer box (not shown). Of course, it will be appreciated that packaging structure 111 may be placed in an outer box before the article to be packaged is positioned on film 154 and flaps 122 and 124 are closed.

As is evident, packaging structure 111 has features which differ from packaging structure 11 described above. Firstly, the different widths of flaps 122 and 124 assure that the seam 127 between the flaps will not be aligned beneath the seam of the flaps of the outer box. As a result of this lack of alignment, flaps 122 and 124 together produce a protective layer which prevents dust and dirt from entering the packaging structure, and which prevents the packaged article from being cut when the outer box is opened. This misalignment also eliminates a structural weak point which would result if the flaps of the outer box were aligned with seam 127.

Extensions 131, 135, 141 and 143 on end legs 138 and 140 provide several advantages. Not only do they permit the preassembly of packaging structure 111, but they increase the strength of the packaging structure by providing a double-wall construction at each corner thereof. Furthermore, in the folded condition of packaging structure 111, the top edges of extensions 131 and 141 are substantially aligned with the top edges of glue strips **156*a* and 156*b*, and the top edges of extensions 135 and 143 are substantially aligned with the top edges of glue strips 158*a* and 158*b*. In these positions, the extensions provide additional support to film 154 and prevent the film from tearing away from side legs 116 and 118 under the weight of the packaged article. Hence, the use of extensions 131, 135, 141 and 143 enables packaging structure 111** to support a heavier article or to provide more rigorous support for articles which are lighter in weight.

In addition, the use of discontinuous glue strips **156*a*, 156*b*, 158*a* and 158*b* increases the free or unadhered edge of film 154, thereby making it easier for film 154 to stretch to accommodate an article packaged thereon. Moreover, arranging the glue strips so that film 154 is not adhered to the center of side legs 116 and 118** keeps the packaged article from exerting a force on the center of the side legs where the packaging structure is weakest, concentrating the exerted force near the corner portions where the packaging structure is strongest.

Figure 7:
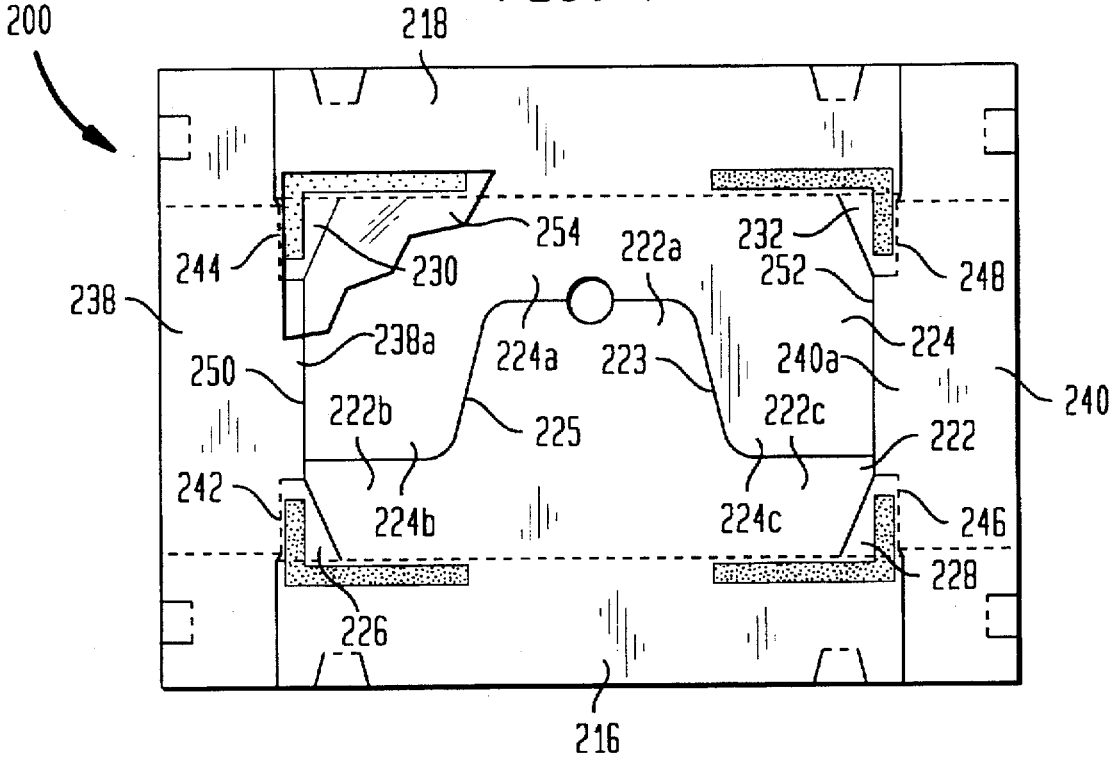
FIG. 7 is a plan view of a blank for forming a packaging structure in accordance with a third embodiment of the present invention.

A blank 200 for forming a packaging structure 211 in accordance with a third embodiment of the present invention is shown in FIG. 7. Blank 200 is substantially similar to blank 100 described above, with the exception that flaps 222 and 224 do not have straight, parallel free edges. Rather, the free edge 223 of flap 222 is profiled so as to define in flap 222 a central portion 222*a* which is wider than side portions 222*b* and 222*c*. The free edge 225 of flap 224 has a complementary profile, i.e., it defines a middle portion 224*a* which is narrower in width than side portions 224*b* and 224*c*. In the closed position in which flaps 222 and 224 are coplanar, free edges 223 and 225 mate with one another to form a layer covering substantially the entirety of flexible film 254.

A further distinction between blank 200 and blank 100 relates to the positions of slit 250 defining the top of end leg 238 and slit 252 defining the top of end leg 240. In blank 200, slit 250 is offset inwardly from fold lines 242 and 244 by a greater amount than the equivalent slit in blank 100 so as to define a centrally disposed projection 238*a* of substantially increased height in end leg 238 (e.g., when end leg 238 is folded downwardly). Likewise, slit 252 in blank 200 is offset inwardly from fold lines 246 and 248 by a greater amount than the equivalent slit in blank 100, thereby creating a centrally disposed projection 240*a* of substantially increased height in end leg 240 (e.g., when end leg 240 is folded downwardly). The purpose of these extensions will become clear from the description of the assembly and use of packaging structure 211 which follows.

Figure 8:
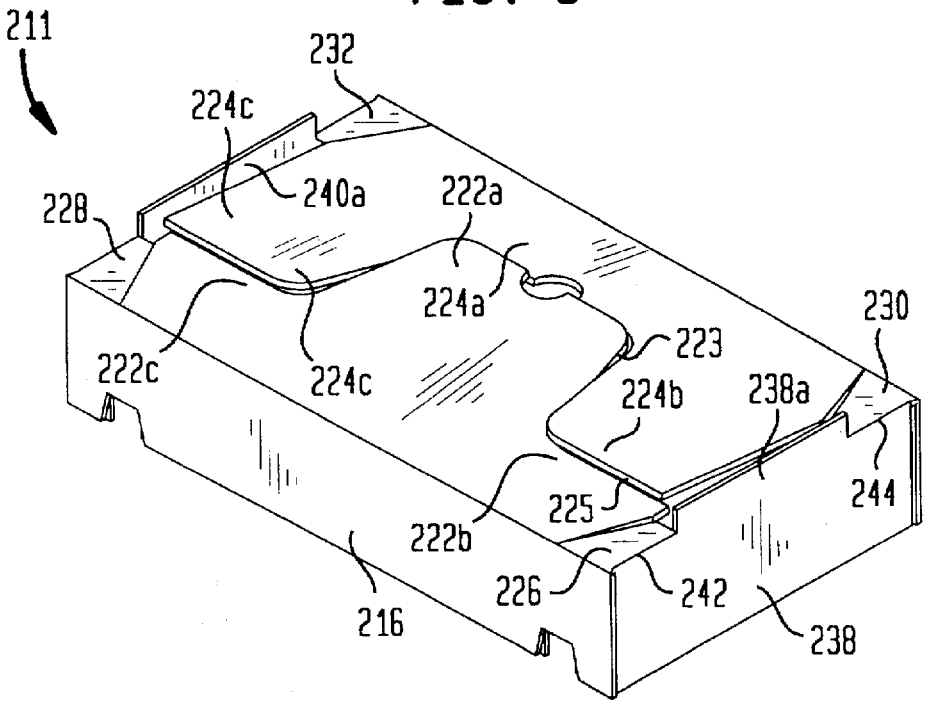
FIG. 8 is a perspective view of the packaging structure constructed from the blank of FIG. 7.
Figure 9:
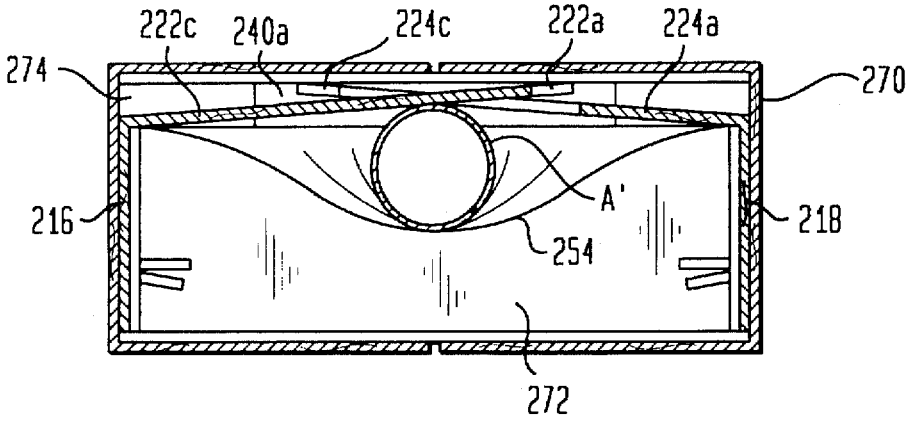
FIG. 9 is a side cross-sectional view of the packaging structure of FIG. 8 within an outer container.

Blank 200 may be folded and assembled in the same manner as described above in connection with blank 100 in order to form the packaging structure 211 shown in FIG. 8. As with the previously described embodiments, the action of folding side legs 216 and 218 downwardly causes flaps 222 and 224 to rotate to an open position, revealing the film 254 across window 233 (not shown). After the article A' to be packaged is placed on the surface of film 254, flaps 222 and 224 may be folded downwardly to the closed position. In this embodiment, however, flaps 222 and 224 are not intended to be folded completely to the closed position. Rather, they are intended to be folded downwardly until they contact article A', at which point they will intersect one another in a criss-cross pattern. As the outer flaps of box 270 are closed over packaging structure 211, the applied force will push flaps 222 and 224 against article A' and cause film 254 to deflect downwardly into the open space 272 between film 254 and the bottom of box 270. As can be seen in the cross-sectional view of FIG. 9, with box 270 completely closed, portion 222*a* of flap 222 and portions 224*b* and 224*c* of flap 224 will be pressed against the top of the box, forming a criss-cross arrangement which occupies the otherwise empty space or air cell 274 between the top of the box and corner portions 226, 228, 230 and 232.

It will be appreciated that packaging structure 211 has features which are different from those of packaging structures 11 and 111 described above. Most notably, the criss-cross arrangements of flaps 222 and 224 produces a spring-loaded effect between packaged article A' and the top of outer box 270. This spring-loaded effect absorbs shocks from dropping box 270 upside down or dropping objects on the top of box 270, thus providing a greater degree of protection to the packaged article A'.

Projections 238*a* and 240*a* on end flaps 238 and 240, respectively, also serve a protective function. Preferably, projections 238*a* and 240*a* are sized so that they contact the top flaps of box 270 when the bottoms of end legs 238 and 240 are positioned against the bottom of the box. In this way, projections 238*a* and 240*a* define the height of the empty space 274 between packaging structure 211 and the top of box 270. Projections 238*a* and 240*a* may also absorb a portion of any force exerted on the top of box 270, thereby preventing an excessive amount of force from being exerted on the spring-loaded flaps and article A' which may damage the article or cause film 254 to tear. Also, if box 270 were to be dropped upside down, projections 238*a* and 240*a* would prevent packaging structure 211 from shifting within outer box 270, whereupon an excessive amount of force also could be exerted on the spring-loaded flaps and the packaged article.

Figure 10:
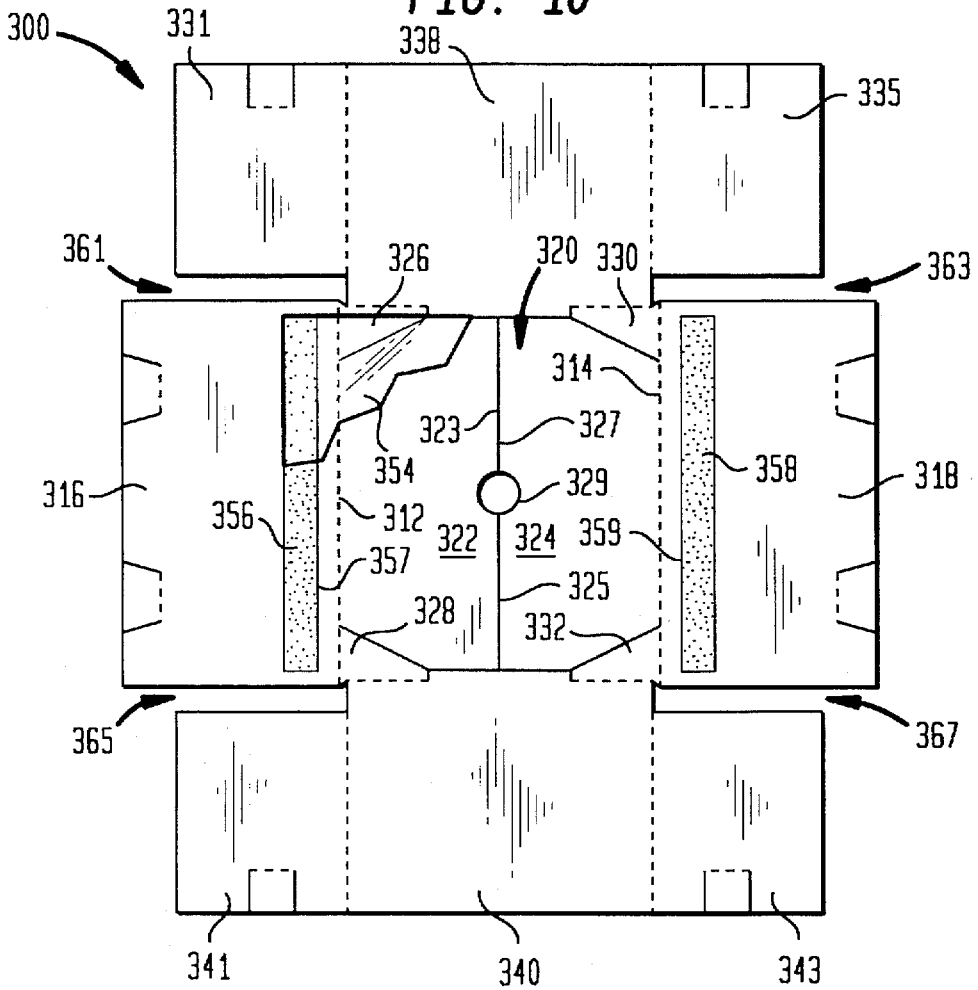
FIG. 10 is a plan view of a blank for forming a packaging structure in accordance with a fourth embodiment of the present invention.

A blank 300 for forming a packaging structure 311 in accordance with a fourth embodiment of the present invention is shown in FIG. 10. Blank 300 includes a pair a fold lines 312 and 314 which are generally parallel to and spaced from the opposite side edges of the blank, and which thus define folding side legs 316 and 318, respectively, and a main portion indicated generally at 320 therebetween. Main portion 320 may include a pair of flaps 322 and 324, and a series of corner portions 326, 328, 330 and 332. Flap 322 may be connected to side leg 316 along the portion of fold line 312 extending between corner portions 326 and 328. Similarly, flap 324 may be connected to side leg 318 along the portion of fold line 314 extending between corner portions 330 and 332. Flaps 322 and 324 may be pivoted about their associated fold lines between an open position revealing window 333 through main portion 320, and a closed position in which they form a layer covering substantially the entirety of window 333. Flap 322 may have a width between fold line 312 and its free edge 323 which is substantially equal to the width of flap 324 between fold line 314 and its free edge 325 such that, in the closed position of flaps 322 and 324, their free edges define a seam 327 which is disposed substantially along the centerline of main portion 320, as well as a finger hole 329 therein.

Blank 300 may further include a pair of folding end legs 338 and 340 which are similar to end legs 138 and 140 of blank 100. Thus, end leg 138 may include extensions 331 and 335 foldably connected on either side thereof, and end leg 340 may include extensions 341 and 343 foldably connected on either side thereof. Extensions 331, 335, 341 and 343 may include tabs which cooperate with tabs formed in side legs 316 and 318 to hold end legs 338 and 340 in assembled position to side legs 316 and 318. Unlike the end leg extensions described above, however, extensions 331 and 341 each may define an offset gap by which it is spaced from an end of side leg 316. Thus, extension 331 may be separated from side leg 316 by an offset gap 361, and extension 341 may be separated from side leg 316 by an offset gap 365. Similarly, extension 335 may be separated from an end of side leg 318 by an offset gap 363 and extension 343 may be separated from an end of side leg 318 by an offset gap 367. Generally, but not necessarily, gaps 361, 363, 365 and 367 will be about the same width.

A flexible film 354 superimposed on one surface of blank 300 and extending across main portion 320 may be connected by glue strip 356 to side leg 316 and by glue strip 358 to side leg 318. As can be seen in FIG. 10, glue strips 356 and 358 may be positioned so as to be spaced from fold lines 312 and 314, respectively. The purpose of this spacing will be understood from the discussion below regarding the assembly and use of packaging structure 311.

Figure 11:
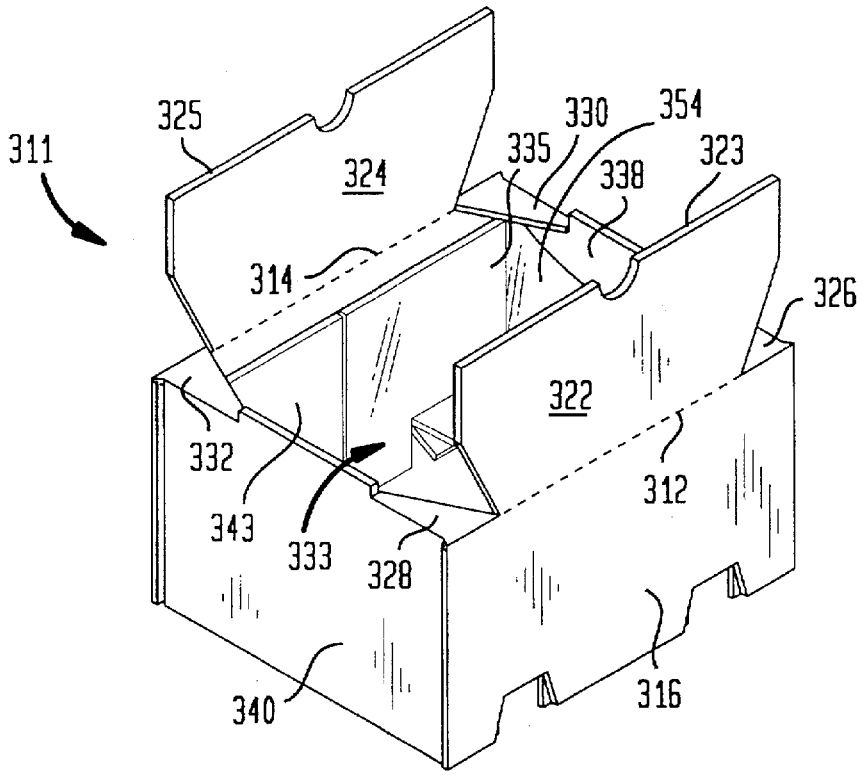
FIG. 11 is a perspective view of the packaging structure constructed from the blank of FIG. 10.
Figure 12:
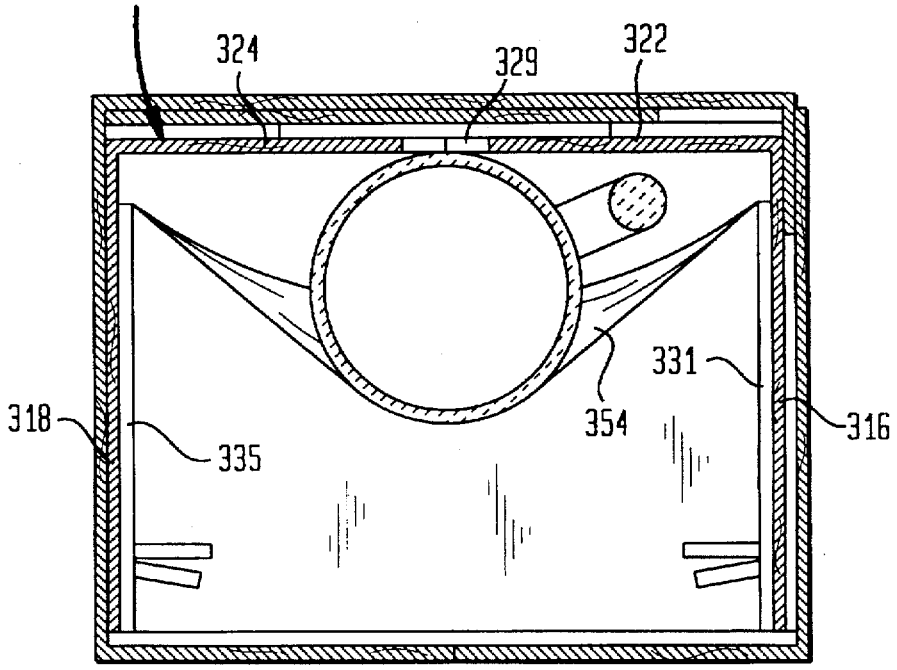
FIG. 12 is a side cross-sectional view of the packaging structure of FIG. 11 within an outer container.

Blank 300 may be folded to form packaging structure 311, shown in FIG. 11, using substantially the same techniques as described above in connection with blanks 100 and 200. As in these other embodiments, the action of folding side legs 316 and 318 downwardly causes flaps 322 and 324 to rotate upwardly to an open position, revealing film 354 through window 333. However, because glue strips 356 and 358 are spaced from fold lines 312 and 314, film 354 does not extend immediately subjacent to window 333. Rather, film 354 is supported at a distance below window 333 which is equivalent to the distance by which glue strips 356 and 358 are spaced from fold lines 312 and 314. Further, because of this spacing between the glue strips and the fold lines, film 354 sags between side legs 316 and 318 instead of being pulled tightly therebetween. That is, as legs 316 and 318 are folded downwardly, the inner edges 357 and 359 of the glue strips (and thus the film adhered thereto) will be moved closer to one another such that the length of film connected between these points will be greater than the distance therebetween. The excess length of film will be equal to the total of the distance between fold line 312 and inner edge 357 of glue strip 356 and the distance between fold line 314 and inner edge 359 of glue strip 358. Hence, by controlling the positioning of glue strips 356 and 358 on side legs 316 and 318, the amount of space between film 354 and window 333 can be controlled so as to be able to snugly package articles having higher profiles.

By making the size of offset gaps 361 and 365 substantially equal to the distance between fold line 312 and the inner edge 357 of glue strip 356, the top edges of extensions 331 and 341 in the folded condition of packaging structure 311 are substantially aligned with glue strip edge 357. Similarly, the size of offset gaps 363 and 367 may be made substantially equal to the distance between fold line 314 and the inner edge 359 of glue strip 358 so that the top edges of extensions 335 and 343 in the folded condition of the packaging structure are in substantial alignment with glue strip edge 359. In these positions, extensions 331, 335, 341 and 343 provide added support for film 354 and prevent it from tearing away from the glue strips. Thus, as the positioning of glue strips 356 and 358 is adjusted to accommodate articles of different thicknesses, the size of offset gaps 361, 363, 365 and 367 may be adjusted so that in the folded condition of packaging structure 311, the top edges of the end leg extensions are properly aligned with the top edges of the glue strips to provide additional support to film 354.

Figure 13:
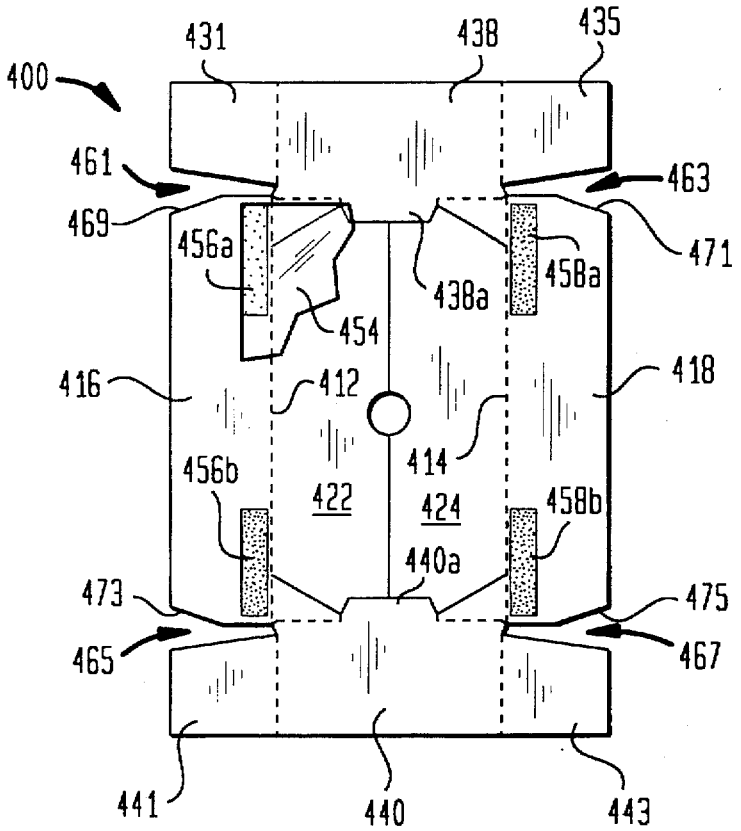
FIG. 13 is a plan view of a blank for forming a packaging structure in accordance with a fifth embodiment of the present invention.

A blank 400 for forming a packaging structure 411 in accordance with a fifth embodiment of the present invention is shown in FIG. 13. Blank 400 is similar in many respects to blank 10 described above. However, unlike blank 10, the end leg 438 of blank 400 may include extensions 431 and 435 foldably connected on either side thereof, and the end leg 440 may include extensions 441 and 443 foldably connected on either side thereof. These extensions are similar to the extensions described in connection with blank 300, but do not include tabs for interconnecting end legs 438 and 440 with side legs 416 and 418. Also, the inner edge of the extensions defining offset gaps 461, 463, 465 and 467 between the extensions and side legs 416 and 418 may be tapered as shown in FIG. 13, the purpose of which will be described below. In addition, unlike blank 10, end legs 438 and 440 may include centrally disposed projections **438*a* and 440*a* which project upwardly from the remainder of end legs 438 and 440 in the folded condition. These projections are similar to projections 238*a* and 240*a* discussed above in connection with packaging structure 211, and serve the same purpose. In a further distinguishing feature, blank 400 may not include glue strip extensions which connect film 454 to the corner portions as in blanks 10, 100 and 200** described above.

Packaging structure 411 may be formed from blank 400 by folding side legs 416 and 418 and end legs 438 and 440 downwardly, and by folding extensions 431, 435, 441 and 443 inwardly of the side legs. Because there are no tabs to interconnect the extensions with the side legs, and because the extensions are tapered, end legs 438 and 440 may be folded downwardly by more than 90 degrees so that they flare upwardly and outwardly. This feature, together with chambers 469 and 473 on the corners of side leg 416 and chambers 471 and 475 on the corners of side leg 418, make it easier to insert packaging structure 411 into an outer box.

Figure 14:
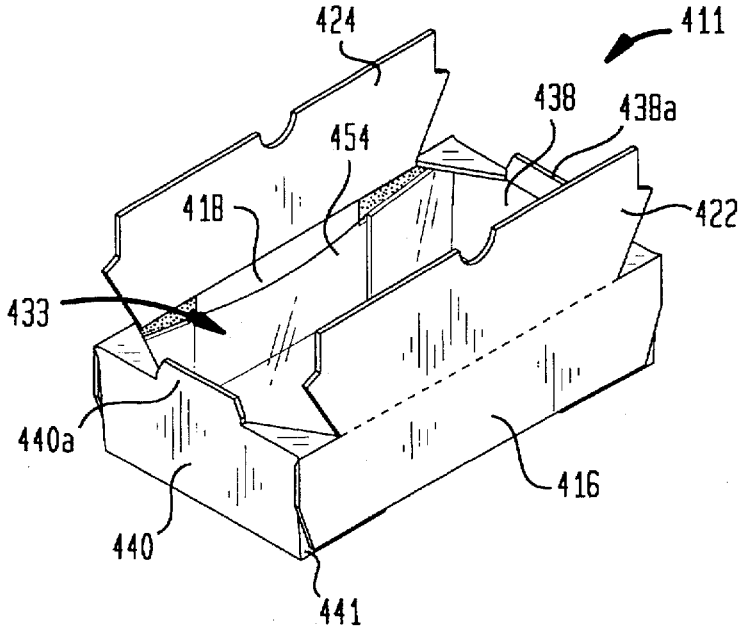
FIG. 14 is a perspective view of the packaging structure constructed from the blank of FIG. 13.

As with the embodiments described above, folding side legs 416 and 418 downwardly causes flaps 422 and 424 to rotate upwardly to the open position shown in FIG. 14, revealing film 454 through window 433. Because glue strips **456*a* and 456*b* are positioned adjacent fold line 412, and glue strips 458*a* and 458*b* are positioned adjacent fold line 414, film 454 is pulled tightly across and immediately subjacent to window 433. Also, unlike the end leg extensions of packaging structure 311, the top edges of extensions 431, 435, 441 and 443 will not be aligned with the top edge of the glue strips. Rather, because of their taper, the top edges of the extensions slope downwardly from a point adjacent their connection to an end leg in which the top edge is in substantial alignment with the top edge of the glue strip toward the free end of the extension in which its top edge is positioned below the top edge of the glue strip. This feature enables packaging structure 411 to be used to package either a low profile article or a high profile article at any one time. Where a low profile article is packaged, closing flaps 422 and 424 causes film 454 to deflect slightly as the article is compressed therein, whereupon the article will be held securely in place. On the other hand, where a higher profile article is packaged, closing flaps 422 and 424 causes film 454 to tear away from the glue strips on side legs 416 and 418 until the film contacts and is held in place by the upper edges of extensions 431, 435, 441 and 443. The taper of the extensions may create a cradle effect in which the film is looser in the center of packaging structure 411** than at its ends.

Figure 15:
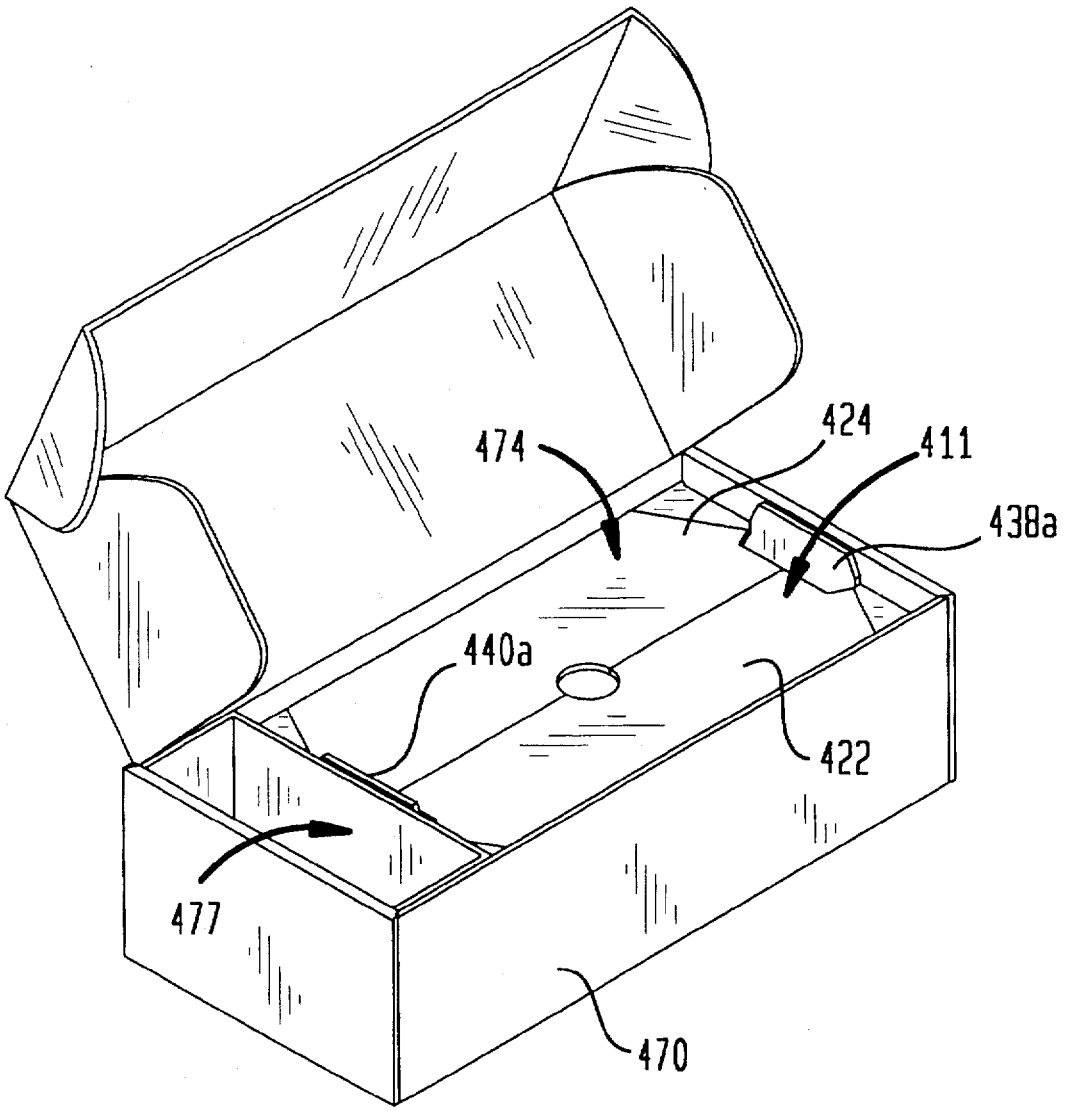
FIG. 15 is a perspective view of the packaging structure of FIG. 14 within an outer container.

As can be seen in FIG. 15, in the folded condition of packaging structure 411, end leg projections **438*a* and 440*a* extend upwardly from flaps 422 and 424. Thus, projections 438*a* and 440*a* fill the height of outer box 470 to prevent packaging structure 411 from shifting vertically within the box. Also, projections 438*a* and 440*a* define an empty space or air cell 474 between the top of box 470 and closed flaps 422 and 424, which empty space may be used to provide extra protection for the article packaged in the box, or a space for packaging instruction manuals, accessories or other items between the top of the flaps and the top of the box. As can also be seen in FIG. 15, packaging structure 411 (as all of the other packaging structures described herein) may be used in an outer box having a length greater than that of the packaging structure, leaving a void space 477** for packaging power cords, accessories, or other less fragile components.

Figure 16:
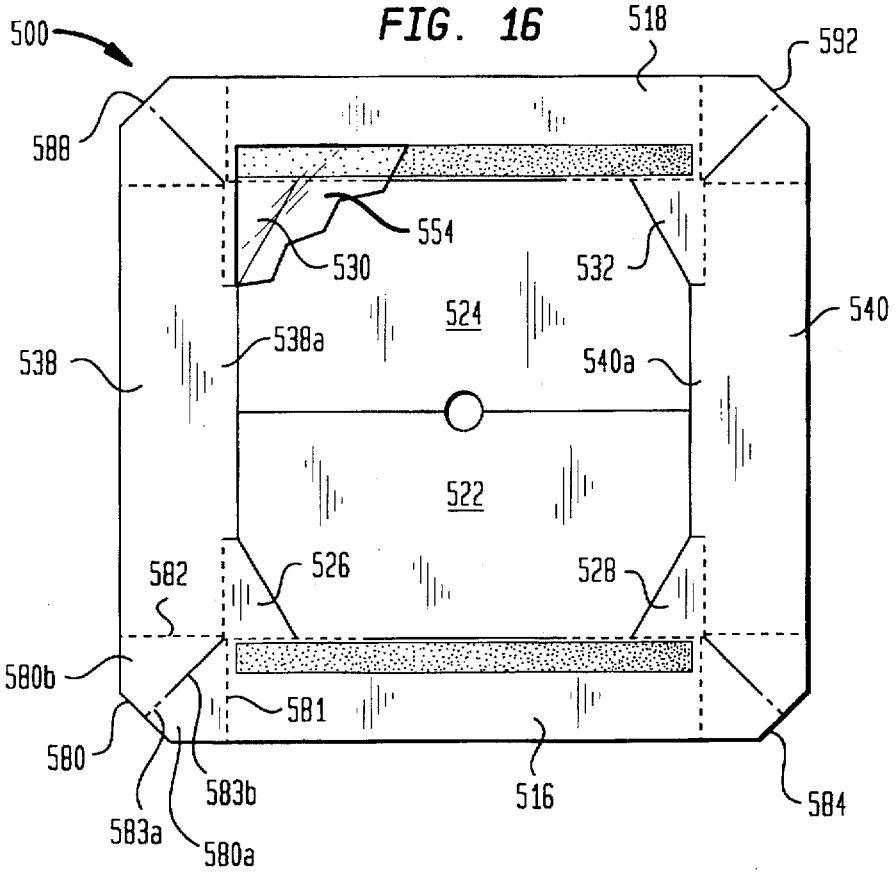
FIG. 16 is a plan view of a blank for forming a packaging structure in accordance with a sixth embodiment of the present invention.
Figure 17:
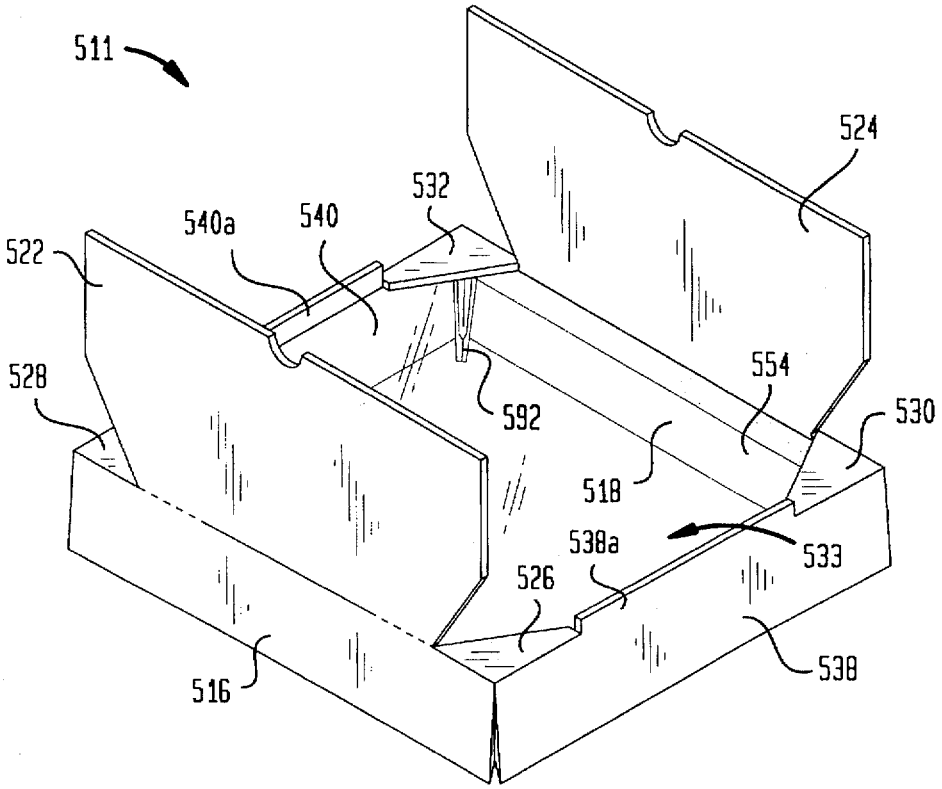
FIG. 17 is a perspective view of the packaging structure constructed from the blank of FIG. 16.

A blank 500 for forming a packaging structure 511 in accordance with a fifth embodiment of the present invention is shown in FIG. 16. Blank 500 has a substantially similar construction to blank 10 described above. However, rather than being connected only by corner portions 526, 528, 530 and 532, side legs 516 and 518 are connected to end legs 538 and 540 by bellows corners 580, 584, 588 and 592. Thus, bellows corner 580 may be connected along fold line 581 to one end of side leg 516, and along fold line 582 to one end of end leg 538. A fold line 583*a* may bisect the angle between fold lines 581 and 582 to foldably divide corner 580 into two equal portions 580*a* and 580*b*. To facilitate this folding action, fold line 583*a* may include a through slit 583*b* extending from corner portion 526 outwardly to a spaced distance from the free diagonal edge of corner 580. Corners 584, 588 and 592 may have the same structure and are therefore not discussed in detail. Since bellows corners 580, 584, 588 and 592 hold side legs 516 and 518 in assembled relationship to end legs 538 and 540, corner portions 526, 528, 530 and 532 optionally may be eliminated from the structure. In such event, film 554 may be adhered to end legs 538 and 540 in addition to side legs 516 and 518 to more evenly distribute the load exerted by the packaged article. The elimination of these corner portions will allow for a larger window 533 without increasing the overall size of packaging structure 511 or, conversely, will allow an article to be packaged in a smaller overall packaging structure.

Blank 500 also differs from blank 10 in that it incorporates the feature of projections 538*a* and 540*a* on end legs 538 and 540, and eliminates the use of any glue strip extensions on corner portions 526, 528, 530 and 532.

To form packaging structure 511 from blank 500, side legs 516 and 518 and end legs 538 and 540 are folded downwardly. As side leg 516 and end leg 518 are folded downwardly, bellows corner 580 is constructed therebetween by folding portion 580*a* inwardly along fold line 581 and portion 580*b* inwardly along fold line 582, while at the same time folding portions 580*a* and 580*b* relative to one another along fold line 583*a*. Bellows corners 584, 588 and 592 may be placed in the folded condition using the same technique. As with the other embodiments of the packaging structures described above, folding side legs 516 and 518 downwardly causes flaps 522 and 524 to rotate to the open position, revealing film 554 extending tightly across and immediately subjacent to window 533. Once placed in the folded condition, packaging structure 511 may be inserted into an outer box (not shown), an article may be placed on film 554, flaps 522 and 524 may be closed and the flaps of the outer box may be closed and sealed to hold the article securely in place within the packaging structure.

In addition to the several embodiments described above, the packaging structure of the present invention may be varied in many ways. For example, it will be appreciated that any of the features described in connection with a particular embodiment hereof may be incorporated in any other embodiment described herein. In one variant, the spring-loaded flaps or the end leg projections of packaging structure 211 may be incorporated in packaging structure 11. In another variant, the unequal door widths of packaging structure 111 or the offset glue strips of packaging structure 311 may be incorporated in packaging structures 411 or 511. Also, rather than a pair of flaps as described in the various embodiments above, a packaging structure may be provided with a single flap foldably connected to one side leg and extending in a closed position across the entire window. Alternatively, the packaging structure may be provided with four flaps, two flaps being foldably connected to the side legs and two flaps being foldably connected to the end legs. The flaps may be triangular or rectangular in shape so that they meet in abutting relationship to enclose the window. It will also be appreciated that the flexible film may be adhered or otherwise connected to the end legs of the packaging structure, rather than the side legs or, as noted above, to both the end legs and the side legs.

The packaging structures of the present invention may be used with any style outer box, including the standard RSC style carton shown in FIG. 2, the standard roll end lock front style carton shown in FIG. 15, standard tuck end cartons, standard roll end tuck top cartons, and other styles of slotted and die cut cartons. As is also shown in FIG. 15, the packaging structures may be used in combination with inserts forming a separate compartment within the box for packaging of less fragile accessories and the like. Furthermore, rather than being formed as a separate component for insertion into an outer box, the packaging structure may be formed integrally with the outer box. In an example of such structure, one side leg of the packaging structure may also be the front wall of a standard top load die cut style carton.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A packaging structure for holding an article, comprising a frame including a main portion defining a window opening, and a pair of side legs depending from said main portion;

at least one flap foldably connected at one edge to one of said side legs for movement between an open position remote from said window opening and a closed position adjacent said window opening; and a flexible web connected to said side legs so as to extend across said window opening between said side legs, whereby an article may be held in place between said web and said at least one flap.

2. A packaging structure as claimed in claim 1, wherein said web is connected to said side legs adjacent said main portion.

3. A packaging structure as claimed in claim 1, wherein said web is connected to said side legs at a spaced distance from said main portion.

4. A packaging structure as claimed in claim 1, further comprising a pair of end legs depending from said main portion.

5. A packaging structure as claimed in claim 4, wherein each one of said pair of side legs is connected to said pair of end legs at a position remote from said main portion.

6. A packaging structure as claimed in claim 5, further comprising a series of bellows connectors, each bellows connector interconnecting one of said side legs with an adjacent one of said end legs.

7. A packaging structure as claimed in claim 4, further comprising a series of corner supports in said main portion for connecting said pair of side legs and said pair of end legs to said main portion.

8. A packaging structure as claimed in claim 7, wherein said corner supports extend coplanar with said window opening.

9. A packaging structure as claimed in claim 8, wherein said web is further connected to said corner supports.

10. A packaging structure as claimed in claim 7, wherein each of said corner supports includes a first edge foldably connected to one of said side legs, a second edge transverse to said first edge and foldably connected to one of said end legs, and at least one other edge interconnecting said first and second edges and defining a portion of said window opening.

11. A packaging structure as claimed in claim 4, wherein each of said end legs includes a pair of extensions connected to opposite ends thereof, each extension being connected to said end leg along a fold line so as to be foldable to a position in overlapping relationship with one of said side legs.

12. A packaging structure as claimed in claim 11, wherein said web is connected to said side legs along joining lines having a top edge and a bottom edge, and each of said extensions in said folded position has a top edge in substantial alignment with said top edge of said joining line.

13. A packaging structure as claimed in claim 11, wherein said web is connected to said side legs along joining lines having a top edge and a bottom edge, and each of said extensions in said folded position has a top edge which tapers downwardly from a point adjacent said fold line in which said top edge is in substantial alignment with said top edge of said joining line toward a free end of said extension in which said top edge is positioned below said top edge of said joining line.

14. A packaging structure as claimed in claim 1, wherein said pair of side legs are foldably connected to said main portion.

15. A packaging structure as claimed in claim 1, wherein said at least one flap includes a cutout defining an opening therethrough when said at least one flap is in said closed position.

16. A packaging structure as claimed in claim 1, further comprising another flap connected at one edge to another one of said side legs for movement between an open position remote from said window opening and a closed position adjacent said window opening.

17. A packaging structure as claimed in claim 16, wherein said at least one flap has a free edge opposite said one of said side legs and said another flap has a free edge opposite said another one of said side legs, said free edges of said flaps being substantially parallel to one another.

18. A packaging structure as claimed in claim 16, wherein a free edge of said at least one flap has a first contour including a center portion and a pair of side portions on either side of said center portion, said center portion extending closer to said another one of said side legs than said side portions, and a free edge of said another flap defines a contour which is complementary to said first contour.

19. A packaging structure as claimed in claim 16, wherein a free edge of said at least one flap in said closed position confronts a free edge of said another flap in said closed position to define a seam therebetween, said seam being positioned substantially along a centerline of said main portion.

20. A packaging structure as claimed in claim 16, wherein a free edge of said at least one flap in said closed position confronts a free edge of said another flap in said closed position to define a seam therebetween, said seam being positioned closer to said one of said side legs than to said another one of said side legs.

21. A packaging assembly assembly for holding an article, comprising a box; and a packaging structure assembled in said box, said packaging structure including a frame having a main portion defining a window opening and a pair of side legs depending from said main portion, at least one flap foldably connected at one edge to one of said side legs for movement between an open position remote from said window opening and a closed position adjacent said window opening, and a flexible web connected to said side legs so as to extend across said window opening between said side legs, whereby an article may be held in place in said packaging structure between said web and said at least one flap.

22. A packaging assembly as claimed in claim 21, further comprising a pair of end legs depending from said main portion.

23. A packaging assembly as claimed in claim 21, wherein said packaging structure has a first height, and said box has a height which is greater than said first height so as to define a space between said main portion and a top of said box.

24. A packaging assembly as claimed in claim 23, wherein said frame further includes a pair of projections extending between said main portion and said top of said box.

25. A packaging assembly as claimed in claim 21, wherein said packaging structure has a first length, and said box has a length which is greater than said first length, whereby an auxiliary compartment is formed in said box alongside said packaging structure.

26. A method for packaging an article comprising the steps of:

providing a planar blank having a main portion defining a window opening, a pair of side legs foldably connected to said main portion, at least one flap foldably connected at one edge to one of said side legs, and a flexible web connected to said side legs so as to extend across said window opening between said side legs;

folding said side legs downwardly, whereupon said at least one flap is pivoted to an open position coplanar with said one of said side legs and said flexible web is exposed through said window opening;

placing the article on said flexible web;

holding said side legs in a substantially fixed position while folding said at least one flap to a closed position over the article, whereupon said flexible web is deformed by the article and the article is held in place between said flexible web and said at least one flap.

* * * * *